US009127428B2

(12) United States Patent
Meier

(10) Patent No.: US 9,127,428 B2
(45) Date of Patent: Sep. 8, 2015

(54) SHEATHING ARRANGEMENT FOR A SOIL-WORKING ROLLER, IN PARTICULAR FOR A SELF-PROPELLED SOIL COMPACTOR

(71) Applicant: HAMM AG, Tischenreuth (DE)

(72) Inventor: Matthias Meier, Tirschenreuth (DE)

(73) Assignee: HAMM AG, Tirschenreuth (DE)

( * ) Notice: Subject to any disclaimer, the term of this patent is extended or adjusted under 35 U.S.C. 154(b) by 16 days.

(21) Appl. No.: 14/086,020

(22) Filed: Nov. 21, 2013

(65) Prior Publication Data

US 2014/0140768 A1 May 22, 2014

(30) Foreign Application Priority Data

Nov. 22, 2012 (DE) ..... 10 2012 221 344

(51) Int. Cl.
*E02D 3/026* (2006.01)

(52) U.S. Cl.
CPC ..... *E02D 3/026* (2013.01); *Y10T 29/49826* (2015.01)

(58) Field of Classification Search
CPC ..... E02D 3/026; E01C 19/26; E01C 19/43; E01C 19/286; B60B 15/025
USPC ..... 404/121, 122, 124, 128; 301/40.5; 172/534, 535, 537, 541; 180/20
See application file for complete search history.

(56) References Cited

U.S. PATENT DOCUMENTS

| | | | | | |
|---|---|---|---|---|---|
| 348,284 | A * | 8/1886 | Horton | ..... | 172/247 |
| 724,896 | A * | 4/1903 | Lavendar | ..... | 301/39.1 |
| 963,618 | A * | 7/1910 | Moore | ..... | 172/535 |
| 1,932,267 | A * | 10/1933 | Francis | ..... | 301/40.5 |
| 2,037,412 | A * | 4/1936 | Finch | ..... | 301/40.5 |
| 2,132,955 | A * | 10/1938 | Johnson | ..... | 301/40.5 |
| 2,136,975 | A * | 11/1938 | Keeten | ..... | 301/39.1 |
| 2,409,246 | A * | 10/1946 | Breeze | ..... | 301/40.5 |
| 2,582,199 | A | 1/1952 | Gardner et al. | | |
| 3,610,116 | A * | 10/1971 | Viefhaus | ..... | 404/121 |
| 3,623,406 | A | 11/1971 | Leben | | |
| 4,632,599 | A * | 12/1986 | Sadahiro | ..... | 404/124 |
| 5,511,901 | A | 4/1996 | Yates | | |
| 2003/0019195 | A1 | 1/2003 | Berndt et al. | | |
| 2011/0251036 | A1 * | 10/2011 | Doetsch et al. | ..... | 492/48 |
| 2012/0312567 | A1 * | 12/2012 | Ugru | ..... | 172/108 |

FOREIGN PATENT DOCUMENTS

| | | |
|---|---|---|
| DE | 331834 | 12/1917 |
| DE | 1634686 | 9/1970 |
| GB | 1211568 | 11/1970 |
| JP | S4835504 U | 4/1973 |

OTHER PUBLICATIONS

First Examination Report (German translation and machine English translation) together with corresponding Search Report issued for Czech Republic Application No. PV 2013-772, dated Jul. 2, 2014, 9 pages.

* cited by examiner

*Primary Examiner* — Abigail A Risic

(74) *Attorney, Agent, or Firm* — Rothwell, Figg, Ernst & Manbeck, P.C.

(57) ABSTRACT

A sheathing arrangement for a soil-working roller (10), in particular for a soil compactor, comprises a plurality of immediately consecutive sheathing members (22) that are connected or connectable in chain-type fashion in longitudinal direction of an arrangement (L).

17 Claims, 2 Drawing Sheets

Figure 1:
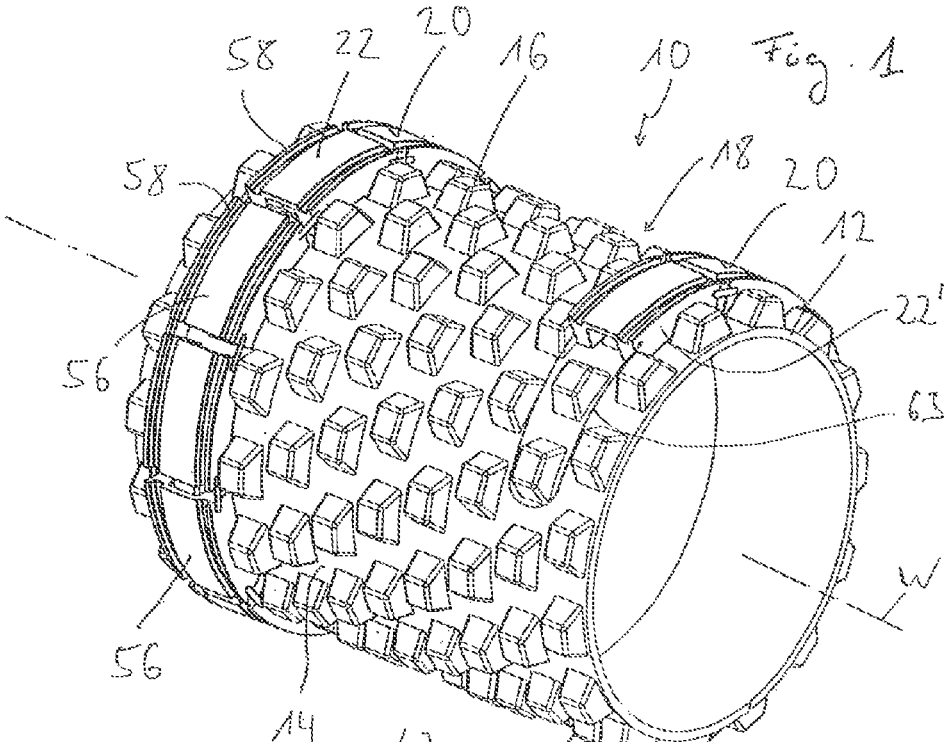

SHEATHING ARRANGEMENT FOR A SOIL-WORKING ROLLER, IN PARTICULAR FOR A SELF-PROPELLED SOIL COMPACTOR

CROSS REFERENCE TO RELATED APPLICATION

This application claims the benefit of German Patent Application No. 10 2012 221 344.9 filed on Nov. 22, 2012, the disclosure of which is incorporated herein in its entirety by reference.

The present invention relates to a sheathing arrangement for a soil-working roller, as may be provided, for example, on a self-propelled soil compactor.

Soil compactors are used, for example, in road- and field construction for working various types of soil. For example, such soil compactors are used to compact gravel, for example to subsequently apply a layer of concrete or asphalt. Soil can also be compacted with such soil compactors. For this purpose it is known, for example, to provide a multitude of so-called pad feet as roller tools at the outer circumference of such a soil-working roller. If a soil compactor is also to be used to crush rocks lying on the substrate, a soil-working roller can be equipped with chisels as roller tools, which break up larger rocks when passing over them.

When such soil-working rollers are equipped with roller tools at their external circumference, they can be used primarily only at the respective site. Travel on firm and/or asphalt-covered roads, and also the transport on a truck, is not possible because of the high contact pressure exerted by the roller tools, which would cause damage to the substrate and/or a loading surface. For this reason, the transport of soil compactors with soil-working rollers constructed in this way requires the disassembly of the roller tools provided at the external circumference of the soil-working rollers, which can be in a range of 150 each, for example, and their reassembly at the new site of use, which requires a high effort in terms of time and cost.

The object to be attained by the present invention is to provide a sheathing arrangement that can be easily mounted to a soil-working roller and allows the movement of a soil compactor equipped in this way on fortified streets or paths and/or transportation on a truck.

According to the invention, the object of the invention is attained with a sheathing arrangement for a soil-working roller, in particular for a soil compactor, comprising a multitude of sheathing members that are connected or connectable immediately consecutive in a chain-type fashion in longitudinal direction of an arrangement.

Because of its chain-type overall structure, a sheathing arrangement according to the invention can be wrapped around the external circumference of a soil-working roller and then forms a ring that encloses the soil-working roller. With one and/or a plurality of such sheathing arrangements wrapped in said ring-type fashion around the external circumference, a soil-working roller and/or a soil-compactor equipped with said soil-working roller can also move on a fortified substrate, such as a street, for example, or it be driven on a truck, without the roller tools provided at the external circumference of the soil-working roller coming into contact with and damaging the substrate.

To be able to position the sheathing arrangement at the external circumference of a soil-working roller in such a way that a mutual interference with a profile formed at the external circumference of said soil-working roller, for example by roller tools, is avoided, it is proposed that the sheathing members have a roller profile receiving recess at a side to be positioned to face an external circumference of a soil-working roller.

To ensure that there will be no damaging contact with a substrate, it is proposed that the sheathing members have a running surface formation at a side that is to be positioned facing away from an external side of a soil-working roller, with the structure of the sheathing member(s) preferably being such that they are developed with a U-shaped cross-section, with the running surface formation being provided at an external U-side of a base area that connects two U-legs, and the U-legs forming the roller profile receiving recess between them.

To ensure a stable support of the sheathing members with respect to the soil-working roller as well, it is proposed that the U-legs have, at their ends facing away from the base area, a roller bearing surface to bear against an external circumferential surface of a soil-working roller. This ensures that the contact between the sheathing members and the soil-working roller is created at defined positions and not, for example, in the area formed by roller tools partially developed with sharp ends.

Advantageously, the sheathing members are constructed with synthetic material, preferably hard rubber material. This leads to a relatively low weight and therefore easy handling of the individual sheathing members, and therefore also the entire sheathing arrangement. On the other hand, roll-off noise, for example on a hard substrate, is clearly reduced.

To be able to provide the chain-type structure of the sheathing arrangement in a simple manner, it is proposed that immediately consecutive sheathing members are connected in a pivotable fashion in longitudinal direction of the arrangement by at least one coupling element, preferably two first coupling elements.

In doing so, the existing pivotable coupling of respective sheathing members to one another in the chain-type structure can be realized in a simple manner in that at least a first coupling element comprises, in association with each of the two sheathing members to be connected by said coupling element, a respective coupling pivot that can be inserted into a coupling opening of the respective sheathing member. Establishing and/or also releasing the connection of immediately consecutive sheathing members can be realized in a simple manner if sheathing members to be connected by first coupling elements have on at least one, preferably two lateral sheathing member surfaces facing away from each other, a respective coupling opening, preferably with an essentially orthogonal longitudinal opening axis relative to the longitudinal direction of the arrangement. A very stable connection of the sheathing members to one another and/or the entire sheathing arrangement to a soil-working roller can be obtained in that at least one, preferably two, belt-type second coupling members extend along the sheathing members in longitudinal direction of the arrangement.

To avoid any damage to such second coupling members in a sheathing arrangement attached to a soil-working roller, it is proposed that in the running surface formation, a coupling member receiving recess, which runs in longitudinal direction of the arrangement, is provided in association with every second coupling member.

To retain a stable winding state after a sheathing arrangement has been attached to a soil-working roller, it is proposed that the sheathing members can be positioned in a ring-type closed configuration by a plurality of first coupling elements and/or at least one, preferably two second coupling elements. To create the winding state, a locking arrangement can be provided at a first sheathing member to lock the first sheathing member against circumferential movement at the external circumference of a soil-working roller.

The present invention furthermore relates to a soil-working roller, in particular on a soil compactor, comprising a plurality of roller tools provided at an external circumference of a roller sheath, with a plurality of the roller tools being arranged in immediately adjacent roller tool rings in the direction of a longitudinal roller axis; furthermore comprising at least one, preferably two sheathing arrangements according to the invention, which are preferably arranged in a distance to one another in the direction of the longitudinal roller axis, with each sheathing arrangement being positioned in ring-type closed configuration to overlap with the roller tools of a roller tool ring.

Furthermore, the invention relates to a method for attaching a sheathing arrangement according to the invention at the external circumference of a soil-working roller, preferably a soil compactor, comprising the measures:

a) Positioning at least one sheathing arrangement with immediately consecutive sheathing members in longitudinal direction of the arrangement on a substrate;

b) Moving the soil-working roller in longitudinal direction of the arrangement preferably over the at least one sheathing arrangement and in doing so, winding the at least one sheathing arrangement around the external circumference of the soil-working roller;

c) Creating a ring-type closed configuration of the at least one sheathing arrangement wrapped around the external circumference of the soil-working roller.

With this approach, it is possible to obtain the winding state of at least one sheathing arrangement around the external circumference of a soil-working roller solely by moving forward the soil-working roller and/or a soil compactor having said soil-working roller. Time- and force-intensive manual work processes to sheath the soil-working roller can therefore be largely avoided.

Before or during measure b), all sheathing members of at least one sheathing arrangement can be connected to one another in a chain-type fashion. This means, for example, that the entire sheathing arrangement with all sheathing members can be laid out on the substrate in a structure combined in chain-type fashion. Alternately, it is possible to prepare only one longitudinal section of the sheathing arrangement and then continually lengthen the sheathing arrangement during the process of winding it around the soil-working roller.

Alternately or in addition to this, a first sheathing member can be locked at the external circumference of the soil-working roller prior to or during the measure b). Said locking ensures that, as the soil-working roller moves forward on the sheathing arrangement laid out on the substrate, the first sheathing member and therefore also the subsequent sheathing members coupled with said first sheathing member, are wrapped around the external circumference of the soil-working roller.

With measure c), the ring-type closed configuration of the sheathing arrangement can be established in that a first sheathing member and a last sheathing member are connected by means of at least one first coupling element. Alternately or in addition to this, at least one second, i.e. belt-type sheathing member can be positioned to enclose the sheathing arrangement wrapped around the external circumference of the soil-working roller, therefore establishing and/or supporting the ring-type cohesion.

Figure 2:
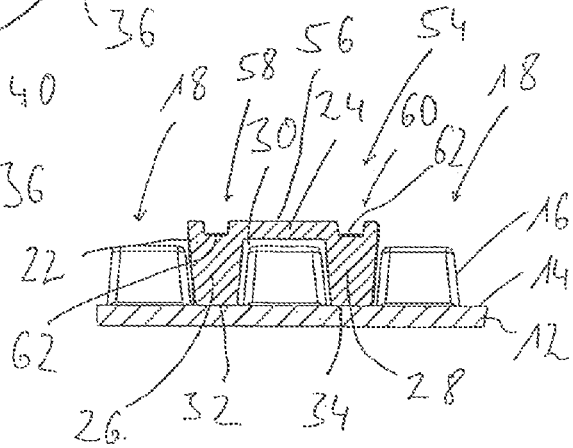
Figure 3:
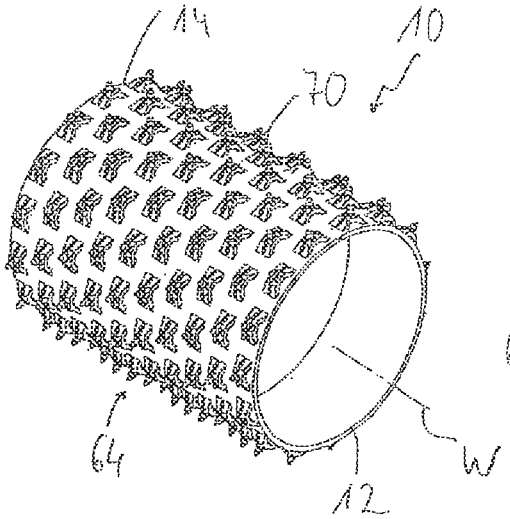
Figure 4:
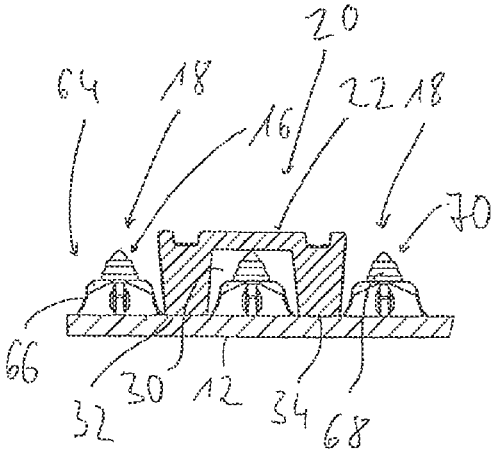
Figure 5:
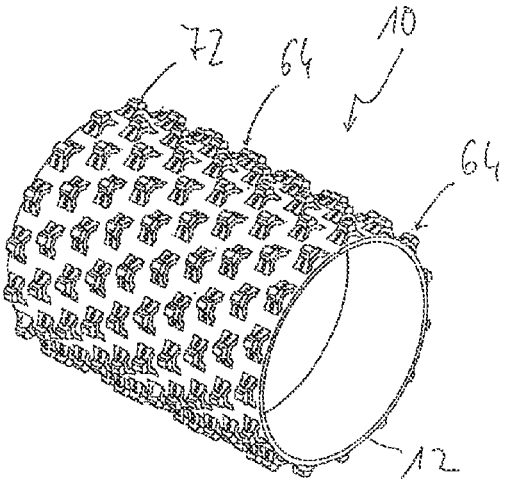
Figure 6:
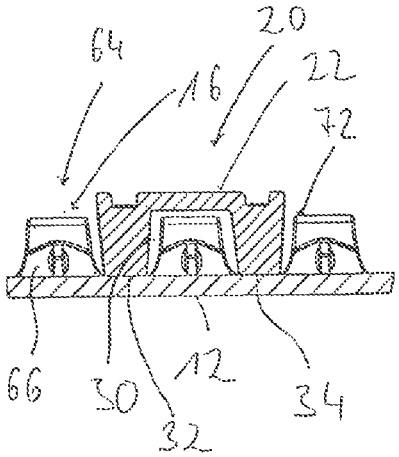

The present invention is explained below in greater detail with reference to the enclosed figures, which show:

FIG. 1 In perspective view, a soil-working roller with two sheathing arrangements wrapped around its external circumference;

FIG. 2 a sectional view of a sheathing member positioned at the external circumference of a soil-working roller;

FIG. 3 a perspective view of a soil-working roller corresponding to FIG. 1, with a different type of roller tools;

FIG. 4 a perspective view of a sheathing member positioned at the external circumference of the soil-working roller in FIG. 3;

FIG. 5 a perspective view of a soil-working roller corresponding to FIG. 1, with a different type of roller tools;

FIG. 6 a sectional view of a sheathing member positioned at the external circumference of the soil-working roller in FIG. 5.

FIG. 1 shows a soil-working roller 10, which can be used, for example, on a self-propelled soil compactor. The soil-working roller 10, which is elongated in the direction of a longitudinal roller axis W and generally developed with a cylindrical structure, comprises a roller sheath 12 and a multitude of roller tools 16, which are welded to an external surface 14 of the roller sheath 12 and developed like pad fetes. Said roller tools are arranged in a plurality of immediately adjacent roller tool rings 18 in direction of the longitudinal roller axis W, for example in an essentially constant circumferential distance to one another, with the roller tools 16 provided in directly adjacent roller tool rings 18 being positioned in an offset fashion relative to one another in circumferential direction.

Two sheathing arrangements 20 are provided at the soil-working roller 10 shown in FIG. 1. The sheathing arrangement 20 provided in FIG. 1 on the left in association with the penultimate roller tool ring 18 at the left end of the soil-working roller 10 is wrapped around the external circumference of the soil-working roller 10 in a ring-type closed configuration. The sheathing arrangement 20 provided in FIG. 1 at the right end of the soil-working roller 10 in association with the penultimate roller tool ring 18 is shown in a state where it does not completely enclose the external circumference of the soil-working roller 10 during the assembly process and/or no longer completely encloses the external circumference of the soil-working roller 10 during a disassembly process.

The two sheathing arrangements 20, which for example are constructed identical with respect to one another, comprise a multitude of sheathing members 22 connected in a chain-type and/or immediately consecutive fashion in longitudinal direction of the arrangement. FIG. 2 also clearly shows that the sheathing members 22 are developed with an essentially U-shaped cross-section and therefore have a base area 24 and U-legs 26, 28 that extend from said base area and/or are connected by said base area. A roller profile receiving recess 30 developed between the two U-legs 26, 28 runs for example over the entire length of the sheathing members 22. In the state shown in FIG. 2, it is obvious that when the sheathing arrangement 20 is wrapped around the external circumference of the soil-working roller 10, the U-legs 26, 28 and their roller bearing surfaces 32, 34 formed by the ends facing away from the base area 24 bear against the external circumferential surface 14 of the roller sheath 12 and in doing so, receive the roller tools 16 provided in a respective roller tool ring 18, e.g. the pad feet. Advantageously, it has been ensured that the roller tools 16 do not abut at the base area 24 so that the entire pressure load is transmitted between the sheathing members 22 and the soil-working roller 10 in the area of the roller bearing surfaces 32, 34. To generate an even contact pressure here, the sheathing members 22 are advantageously developed with a curvature that is, at least in the area of their roller bearing surfaces 32, 34, adapted to the curvature of the external circumferential surface 14 of the roller sheath 12.

FIG. 2 furthermore shows that the width of the sheathing members 22 and/or also the width of the U-legs 26, 28 as well as their mutual distance is adapted on the one hand to the width of the roller tools 16 and/or also to the mutual distance of the immediately adjacent roller tool rings 18 in the direction of the longitudinal roller axis B. This essentially ensures that a respective sheathing arrangement 20 can be attached to the external circumference of the soil-working roller 10 without mutual interference with the roller tools 16 of the respective enclosing roller tool ring 18 and also the roller tools 16 of the roller tool rings 18 located at both sides of said ring.

To obtain the chain-type configuration of the sheathing arrangements 20, immediately consecutive sheathing members 20 can be pivotally connected in longitudinal direction L of the arrangement by first coupling elements 36. As shown in FIG. 1, said first coupling elements can be developed in U-shape, for example, and have a respective coupling pivot 38, 40 in association with each of the sheathing members 22 to be connected. At their two lateral sheathing surfaces 42, 44, which face away from each other transversely to the longitudinal direction L of the arrangement, the sheathing members 22 have, in their two end areas 46, 48 located in longitudinal direction L of the arrangement, respective coupling openings 50, 52 with an essentially orthogonal opening axis relative to the lateral direction L of the arrangement. The coupling pivots 38, 40 of the first coupling members 36 can be inserted into said coupling openings 50, 52 so that two respective first coupling members 36 can pivotally connect the immediately adjacent sheathing members 22. Because of the U-shaped development of the first coupling members 36, there is sufficient space between the sheathing members 22, which are positioned immediately consecutive in longitudinal direction L of the arrangement, to pivot them far enough relative to one another that proceeding from an essentially longitudinal configuration, they can pivot relative to one another into the ring-type configuration that encloses the external circumference of the soil-working roller 10.

On their side that is positioned to face away from the soil-working roller 10, i.e., the external U-side 54, which is also shown in FIG. 2, the coupling members 22 have a running surface formation 56. With said running surface formation 56, which is, for example, curved, essentially smooth, but also profiled, if necessary, the sheathing members 22 wrapped around the external circumference of a soil-working roller 10 come into contact with a substrate over which a soil-working roller 10 developed in this way is moving.

To ensure on the one hand that the sheathing arrangements 20 are easy to handle, but to avoid on the other hand the creation of any roll-off noise as far as possible, the sheathing members may be constructed with synthetic material, preferably hard rubber material. Because of the very simple structure, which is shown in the figures, the sheathing members 22 can be provided, for example, as a single massive block of material. As far as necessary for stability reasons, however, the sheathing members 22 can also have a metal core, which is also developed with a U-shaped cross-section and enclosed with said synthetic material, such as hard rubber material, for example.

At the external U-side 54, i.e. in the area of the running surface formation 56, coupling member receiving recesses 58, 60 are provided in the base area 24, for example where the U-legs 26, 28 extend from said area in longitudinal direction L, which can essentially also correspond to the longitudinal direction of the individual sheathing members 22. In the coupling member receiving recesses 58 and/or 60 of the immediately consecutive sheathing members 22, which continue in the chain-type configuration in longitudinal direction L of the arrangement, two second coupling members 62 are accommodated, which are positioned side-by-side and developed in a belt-like fashion. Said second coupling members 62 are dimensioned such, for example, that they extend as a longitudinal section around the entire external circumference of a soil-working roller 10 around which a sheathing arrangement 20 has been wrapped. The second coupling members 62 can be developed, for example, like so-called ratchet straps and on the one hand ensure and/or support, in addition to the first coupling members 36, the cohesion of the individual immediately consecutive sheathing members 22, but on the other hand also contribute to the cohesion of the ring-type closed structure of a sheathing arrangement 20 wrapped around the external circumference of a soil-working roller 10.

The procedure for mounting a sheathing arrangement 20 constructed as described above at the external circumference of a soil-working roller 10 is such that first at least a part of the sheeting arrangement 20 with preferably all sheathing members 22 is laid out immediately consecutive on a substrate in longitudinal direction L of the arrangement and connected by the first coupling members 36. In doing to, the second coupling members 62 can also already be positioned in the area of the respective coupling member receiving recesses 58, 60 that accommodate them. Then a soil compactor with a soil-working roller 10 to be sheathed is moved in longitudinal direction of the arrangement L toward the sheathing arrangement 20 positioned in this way and/or it is moved over a first sheathing member 22'. To ensure an independent winding in the continuation of the forward movement, a locking arrangement 63, which is developed in loop- or hook-shape, for example, can be provided at said first sheathing member 22'. With said locking arrangement, the first sheathing member 22' is locked at the external circumference of the soil-working roller 10, for example by hooking into a roller tool 16. The first sheathing member 22' is therefore locked at least in circumferential direction relative to the soil-working roller 10, and like the subsequent sheathing members 22 that follow in longitudinal direction of the arrangement L, it is carried along in the further forward movement and wrapped around the external circumference of the soil-working roller 10. This process continues until the soil-working roller 10 has moved almost completely over the sheathing arrangement 20 laid out in longitudinal direction L of the arrangement on the substrate. Then an end configuration member 22' is connected to the first sheathing member 22' to create a ring-type closed configuration, for example by two first coupling members 36 to be inserted into the associated coupling openings 50, 52. Alternatively or in addition, the second coupling members 62 can be closed around the external circumference of the sheathing arrangement 20 and therefore ensure the cohesion of the ring-type configuration.

The process described above can be repeated multiple times to attach a plurality of sheathing arrangements 20 to a soil-working roller 10 and/or it can be performed simultaneously for a plurality of sheathing arrangements 20. The disassembly can occur essentially in reversed order of the steps to be followed.

With the construction of a sheathing arrangement 20 described above, it is possible to equip, in a simple manner, a soil-working roller 10 provided with roller tools 16 in such a way that it can be moved without the risk of damaging the substrate to be traveled. A maximum of two people are needed for the assembly and disassembly, i.e., one person who moves the soil compactor and another person who can give orders about the direction and/or speed of the forward movement. With sufficient experience, it is also possible to perform the entire assembly and disassembly with one only person.

The sheathing arrangement 20 can also be adapted to soil-working rollers 10 with different external circumferences in a simple manner. A rough fitting can be done by selecting the number of sheathing members 22 to be provided in a respective sheathing arrangement 20. Fine adjustment can be done by selecting first coupling members 36 of various dimensions. For example, in association with various known external dimensions of soil-working rollers 10 to be sheathed, first coupling members 36 with corresponding differently spaced coupling pivots 38, 40 can be kept available.

FIGS. 3 to 6 show that a sheathing arrangement 20 constructed as described above can also be used with soil-working rollers of different designs, in particular of the roller tools 16. In FIGS. 3 to 6, the sheathing of a soil-working roller 10 is shown where change holder arrangements 64 are provided. The change holder arrangements 64 comprise at the external circumferential surface 14 of the roller sheath 12 the change holders 66, which are welded on, for example. The arrangement is again such that immediately consecutive roller tool rows 18 are formed in the direction of the longitudinal roller axis W. Various roller tools 16 can be positioned at the change holders 66 and therefore one and the same soil-working roller 10 can be adapted for various uses.

In the example shown in FIGS. 3 and 4, said roller tools 16 are developed as chisels 68, for example round shank chisels with a very hard and pointed chisel head 70, which can be used for breaking up rock. In this configuration, the soil-working roller 10 can be used as a so-called rock-crushing roller.

In the example shown in FIGS. 5 and 6, the roller tools 16 are developed as pad feet 72, which allows the use of the soil-working roller 10 for the compacting of soil, for example, but also for gravel or the like.

Regardless of the equipment of the soil-working roller 10 with the various roller tools 16, i.e. the chisels 70 or the pad feet 72, a sheathing arrangement 20 constructed as described above can be used for sheathing the soil-working roller 10. The FIGS. 4 and 6 show that the sheathing members 22 can be positioned such in association with the roller tool rows 18 that the roller tools 16, which are provided here at the change holder arrangements 64, are completely accommodated in the roller profile receiving recesses 30 of the sheathing members 22 without generating any significant transfer of force contact with the sheathing members 22. The force resistance that occurs when driving over a substrate again occurs essentially completely in the area of the roller bearing surfaces 32, 34 of the sheathing members 22.

The invention claimed is:

1. Sheathing arrangement for a soil-working roller (10), comprising:

a plurality of sheathing members (22) connected or connectable immediately consecutive in chain-type fashion in a longitudinal direction of the arrangement (L), wherein in the longitudinal direction of the arrangement (L), immediately consecutive sheathing members (22) are pivotally connected by at least one first coupling element (36), wherein at least one belt-type second coupling member (62) extends along all of the sheathing members (22) in the longitudinal direction of the arrangement (L), wherein the sheathing members (22) can be positioned in a ring-type closed configuration by the at least one second coupling element (61), and wherein at a first sheathing member (22'), a locking arrangement (63) is provided to lock the first sheathing member (22') against at least circumferential movement at an external circumference of the soil-working roller (10).

2. Sheathing arrangement according to claim 1, wherein the sheathing members (22) have a roller profile receiving recess (30) at a side to be positioned to face the external circumference of the soil-working roller (10).

3. Sheathing arrangement according to claim 1, wherein the sheathing members (22) have a running surface formation (56) at a side to be positioned away from an external side of the soil-working roller (10).

4. Sheathing arrangement according to claim 3, wherein the sheathing members (22) are developed with a U-shaped cross-section, with the running surface formation (56) being provided at an external U-side (54) of a base area (24) that connects two U-legs, and the U-legs (26, 28) forming the roller profile receiving recess (30) between each other.

5. Sheathing arrangement according to claim 4, wherein the U-legs (26, 28) have on their ends facing away from the base area (24) a roller bearing surface (32, 34) to bear against an external circumferential surface (14) of the soil-working roller (10).

6. Sheathing arrangement according to claim 3, wherein in the running surface formation (56), a coupling member receiving recess (58, 60), which extends in the longitudinal direction of the arrangement (L), is provided in association with every second coupling element (62).

7. Sheathing arrangement according to claim 1, wherein the sheathing members (22) are constructed with synthetic material.

8. The sheathing arrangement according to claim 7, wherein the synthetic material is hard rubber material.

9. Sheathing arrangement according to claim 1, wherein at least one first coupling element (36) comprises, in association with each of the two sheathing members (22) to be connected by said coupling element, a respective coupling pivot (38, 40) that can be introduced into a coupling opening (50, 52) of the respective sheathing member (22).

10. Sheathing arrangement according to claim 9, wherein sheathing members (22) to be connected by first coupling elements (36) have on at least one sheathing member lateral surface (42, 44) facing away from each other a respective coupling opening (50, 52), preferably with a longitudinal opening axis that is essentially orthogonal relative to the longitudinal direction of the arrangement (L).

11. The sheathing arrangement of claim 10, wherein the sheathing members to be connected by the first coupling have at least two sheathing member lateral surfaces.

12. Method for attaching a sheathing arrangement (20) according to claim 1 at the external circumference of a soil-working roller (10), comprising the measures:

a. Positioning at least one sheathing arrangement (20) with immediately consecutive sheathing members (22) in the longitudinal direction of the arrangement (L) on a substrate, b. Moving the soil-working roller (10) in the longitudinal direction of the arrangement (L) preferably over the at least one sheathing arrangement (20) and in doing so, winding the at least one sheathing arrangement (20) around the external circumference of the soil-working roller (10), c. Producing a ring-type closed configuration of the at least one sheathing arrangement (20) wrapped around the external circumference of the soil-working roller (10), and enclosing at least one sheathing arrangement (20) wrapped around the external circumference of the soil-working roller (10) by means of at least one second coupling element (62) extending along all of the sheathing members (22) in the longitudinal direction of the arrangement (L), wherein before or after measure b) a first sheathing member (22') is locked at the external circumference of the soil-working roller (10).

13. Method according to claim 12, wherein measure c) comprises:

connecting a first sheathing member (22') to an end sheathing member (22") by means of at least one first coupling element (36).

14. The sheathing arrangement according to claim 1, wherein at least two belt-type second coupling members extend along all of the sheathing members in the longitudinal direction of the arrangement.

15. The sheathing arrangement of claim 1, wherein immediately consecutive sheathing members are pivotably connected by at least two first coupling elements.

16. The sheathing arrangement of claim 1, wherein the sheathing members can be positioned by at least two second coupling elements.

17. Soil-working roller, comprising:

a plurality of roller tools (16) provided at an external circumference of a roller sheath (12), with the roller tools (16) being arranged in a plurality of immediately adjacent roller tool rings (18) in direction of a longitudinal roller axis (L);

two sheathing arrangements (20), which are arranged in the direction of the longitudinal roller axis (L) in a distance to one another, with each sheathing arrangement (20) being positioned to overlap the roller tools (16) of a roller tool ring (18) in ring-type closed configuration, wherein each of said two sheathing arrangements comprises:

a plurality of sheathing members (22) connected or connectable immediately consecutive in chain-type fashion in the longitudinal direction of the arrangement (L), wherein in the longitudinal direction of the arrangement (L), immediately consecutive sheathing members (22) are pivotally connected by at least one first coupling element (36), wherein at least one belt-type second coupling member (62) extends along all of the sheathing members (22) in the longitudinal direction of the arrangement (L), wherein the sheathing members (22) can be positioned in a ring-type closed configuration by the at least one second coupling element (62), and wherein at a first sheathing member (22'), a locking arrangement (63) is provided to lock the first sheathing member (22') against at least circumferential movement at the external circumference of the soil-working roller.

* * * * *